US010960317B2

(12) United States Patent
Hama et al.

(10) Patent No.: US 10,960,317 B2
(45) Date of Patent: Mar. 30, 2021

(54) SPINNING TOP TOY AND SPINNING TOP TOY SET

(71) Applicant: TOMY COMPANY, LTD., Tokyo (JP)

(72) Inventors: Hiroyuki Hama, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 16/668,840

(22) Filed: Oct. 30, 2019

(65) Prior Publication Data

US 2020/0129873 A1 Apr. 30, 2020

(30) Foreign Application Priority Data

Oct. 30, 2018 (JP) ..... JP2018-203866

(51) Int. Cl.
*A63H 1/00* (2019.01)
*A63H 1/04* (2006.01)
*A63F 9/16* (2006.01)

(52) U.S. Cl.
CPC . *A63H 1/04* (2013.01); *A63F 9/16* (2013.01)

(58) Field of Classification Search
CPC ..... A63H 1/00–04
USPC ..... 446/256–264
See application file for complete search history.

(56) References Cited

U.S. PATENT DOCUMENTS 1,267,558 A * 5/1918 Breyer ..... A63H 1/00 446/256
1,291,752 A * 1/1919 Komorous ..... A63H 1/00 446/262
1,401,952 A * 1/1922 Asaturian ..... A63H 1/00 446/263
2,220,823 A * 11/1940 McKeown ..... A63F 9/16 446/264
3,309,813 A * 3/1967 Newlan ..... A63H 1/00 446/258
5,017,172 A * 5/1991 Seifert ..... A63H 1/04 446/250
5,518,437 A * 5/1996 Nonaka ..... A63H 1/02 446/259
8,568,191 B2 * 10/2013 Rehkemper ..... A63H 17/008 446/259
9,457,285 B2 * 10/2016 Rehkemper ..... A63H 1/04
(Continued)

FOREIGN PATENT DOCUMENTS

JP 5793631 B1 10/2015

*Primary Examiner* — Eugene L Kim
*Assistant Examiner* — Matthew B Stanczak
(74) *Attorney, Agent, or Firm* — IP Business Solutions, LLC

(57) ABSTRACT

A spinning top toy for spinning on a surface includes a shaft part and a body. The shaft part includes a shaft part body and a ground contact part being integrally formed with the shaft part body. The shaft part extends in an axial direction. The body is configured on the shaft part. The ground contact part includes a wheel-shaped body being slidably configured on the shaft part body. The wheel-shaped body is configured to be moved to a first position, and is configured to be moved to a second position. The second position is closer to the surface than the second position in the axial direction. The wheel-shaped body is configured to be in contact with the surface when at the second position.

5 Claims, 11 Drawing Sheets

(56) References Cited

U.S. PATENT DOCUMENTS

| | | | | |
|---|---|---|---|---|
| 2003/0199222 | A1* | 10/2003 | Matsukawa | A63H 30/04 446/256 |
| 2005/0142983 | A1* | 6/2005 | Matsukawa | A63H 1/04 446/246 |
| 2010/0159798 | A1* | 6/2010 | Bertrand | A63H 1/02 446/259 |
| 2011/0171876 | A1* | 7/2011 | Ujita | A63H 1/00 446/264 |
| 2011/0189921 | A1* | 8/2011 | Andersen | A63H 33/22 446/242 |
| 2011/0256796 | A1* | 10/2011 | Ujita | A63H 1/00 446/264 |
| 2013/0056929 | A1* | 3/2013 | Rehkemper | A63H 17/004 273/129 R |
| 2014/0302743 | A1* | 10/2014 | Cai | A63H 1/18 446/256 |
| 2016/0030848 | A1* | 2/2016 | Lema | A63F 13/73 463/9 |
| 2017/0239558 | A1* | 8/2017 | Shindo | A63F 9/16 |
| 2018/0229111 | A1* | 8/2018 | Hashiba | A63F 9/16 |
| 2019/0111352 | A1* | 4/2019 | Muraki | A63F 9/16 |
| 2019/0111353 | A1* | 4/2019 | Muraki | A63H 1/04 |
| 2020/0114271 | A1* | 4/2020 | Muraki | A63H 1/00 |
| 2020/0114273 | A1* | 4/2020 | Muraki | A63H 1/04 |

* cited by examiner

SPINNING TOP TOY AND SPINNING TOP TOY SET

CROSS-REFERENCE TO THE RELATED APPLICATION

The present application claims priority under 35 U.S.C. 119 to Japanese Patent Application No. 2018-203866 filed on Oct. 30, 2018. The entire content of Japanese Patent Application No. 2018-203866 is incorporated herein by reference.

TECHNOLOGICAL FIELD

The present invention relates to a spinning top toy and a spinning top toy set.

BACKGROUND TECHNOLOGY

Conventionally, it is well-known that in order to change rotation characteristics by changing a ground contact area of a rotation shaft, a spinning top toy is rotated at a position by reducing a ground contact surface of a ground contact part or the spinning top toy is revolved by enlarging the ground contact surface (see e.g., Patent Document 1).

In the spinning top toy, a rotary plate is arranged on a body circumferential surface. The rotary plate is rotated in one direction, and the first ground contact part is projected from a lower end of a lower member (the second ground contact part). Accordingly, the ground contact surface becomes small. The rotary plate is rotated in the other direction, and the first ground contact part is retracted to the lower member. The lower end of the lower member which is the second ground contact part is grounded, so that the ground contact surface becomes large.

[Patent Document 1] Japanese Patent No. 5793631

SUMMARY

Problems to be Solved by the Invention

However, in this spinning top toy, the lower member, which surrounds the first ground contact part, is formed in an approximately reversed conical shape, and its height is low, so that when the lower member is grounded, the following problems occur. For example, in a case in which the spinning top toy is rotated on a game board which is surrounded by a wall, when the wall is low, the lower member slidably contacts and strands on the wall. Conversely, when the wall is high, there are cases in which the outer circumference of the lower member hits the wall and the spinning top toy is largely flicked out.

Further, in a case in which the height of the approximately reversed conical shaped lower member is low, when the ground contact surface has inclination, the lower surface of the lower member is easily grounded, and when the bottom surface of the lower member is grounded, the spinning top toy is widely moved around.

The present invention was created considering the aforementioned problems. An object is to provide a spinning top toy and a spinning top toy set which can switch rotation characteristics and become a travel mode by the switch.

Means for Solving the Problems

A spinning top toy for spinning on a surface includes a shaft part and a body. The shaft part includes a shaft part body and a ground contact part being integrally formed with the shaft part body. The shaft part extends in an axial direction. The body is configured on the shaft part. The ground contact part includes a wheel-shaped body being slidably configured on the shaft part body. The wheel-shaped body is configured to be moved to a first position, and is configured to be moved to a second position. The second position is closer to the surface than the second position in the axial direction. The wheel-shaped body is configured to be in contact with the surface when at the second position.

BRIEF DESCRIPTION OF THE DRAWINGS

FIG. 7(A) is a cross-sectional view showing the first state, and FIG. 7(B) is a cross-sectional view showing the second state.

FIG. 8(A) is a plane view showing the disassembled state, and FIG. 8(B) is a plane view showing the assembled state.

FIG. 5(A) is a cross-sectional view showing the first state, and FIG. 5(B) is a cross-sectional view showing the second state.

DETAILED DESCRIPTION OF PREFERRED EMBODIMENTS

Figure 1:
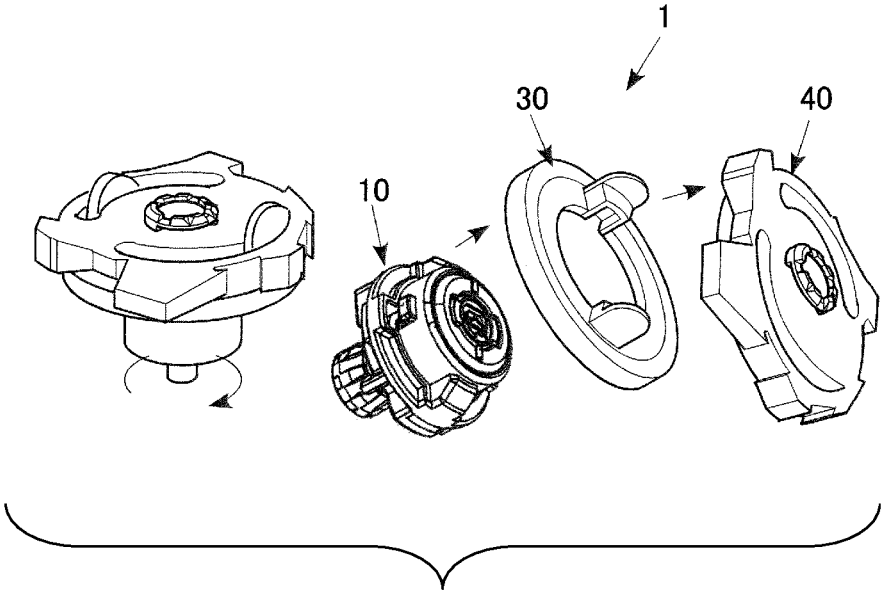
FIG. 1 is a perspective view showing how to play with one embodiment of a spinning top toy according to the first embodiment.

Hereinafter, a spinning top toy of the present invention will be described based on embodiments shown in the drawings.

Whole Structure

Figure 2:
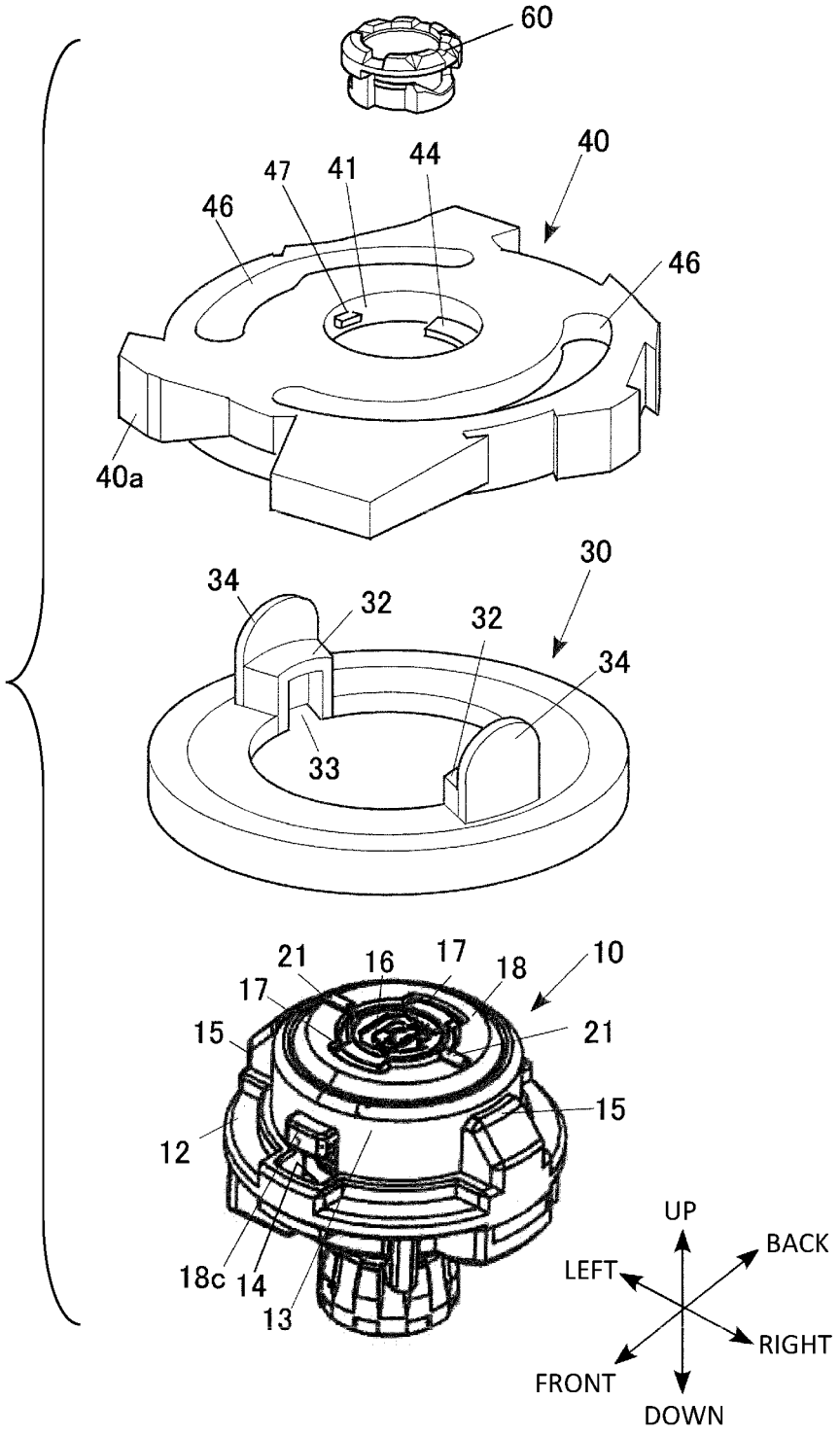
FIG. 2 is an exploded perspective view showing the spinning top toy.

FIG. 1 is a perspective view showing an appearance of a spinning top toy during a battle. FIG. 2 is an exploded perspective view showing the spinning top toy.

The spinning top toy 1 is used for a battle game, etc. for winning or losing by, for example, colliding the spinning top toys each other. The spinning top toy 1 is provided with a shaft part 10, a flywheel 30, and a body 40.

Detail Structure>Regarding a Shaft Part 10

Figure 4:
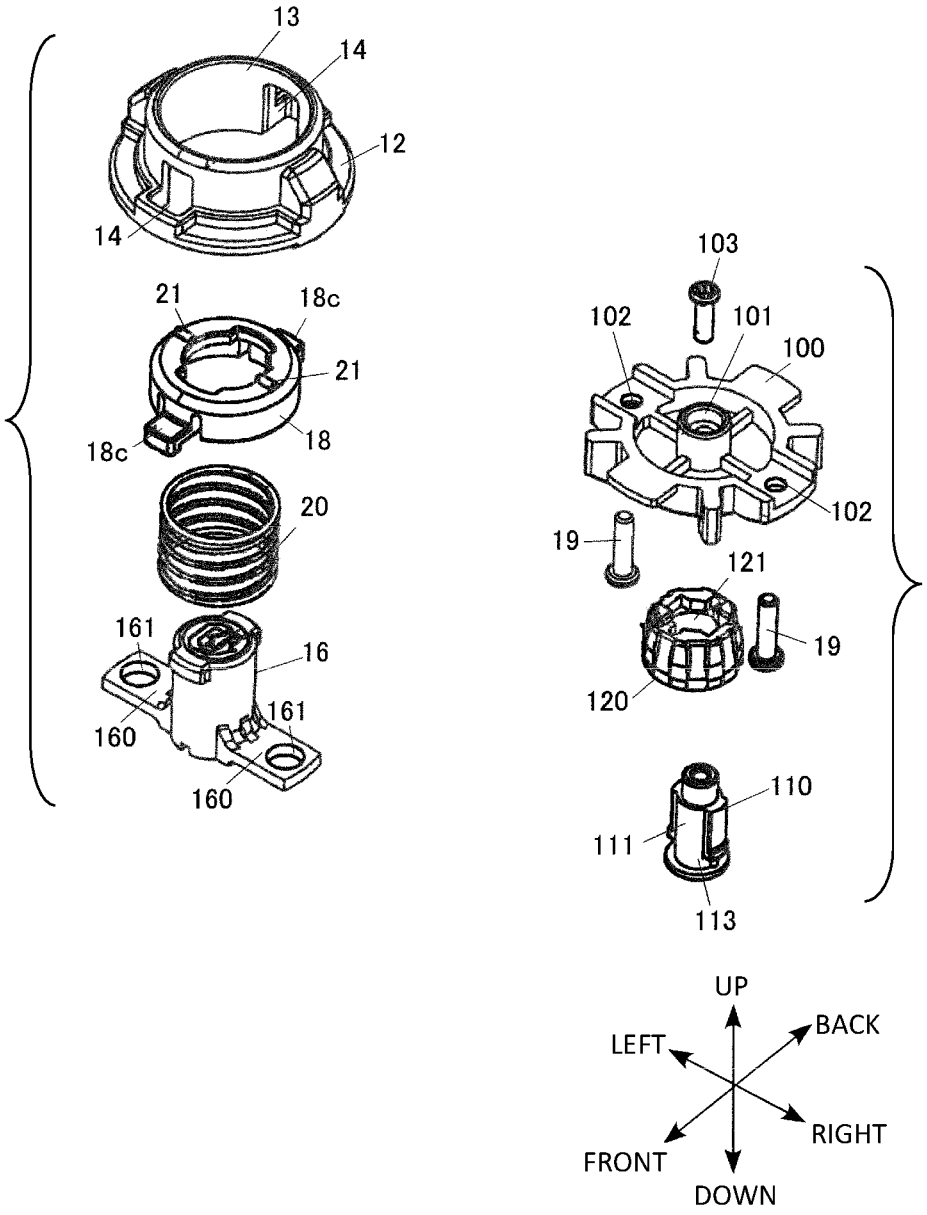
FIG. 4 is an exploded perspective view showing a shaft part when viewed from the upper side.

As shown in FIG. 2, the shaft part 10 is provided with a ground contact member (the first ground contact member 110 and the second ground contact member 120 shown in FIG. 4) in the lower end part, a flange 12 in the middle part in the vertical direction, and a cylindrical part 13 in the upper part. Among these parts, the flange 12 and the cylindrical part 13 are integrally formed and it is configured as the shaft part upper part. The flange 12 and the cylindrical part 13 are fixed to the shaft part lower part by male screws 19 (see FIGS. 4 and 5).

(1) Shaft Part Lower Part

Figure 5:
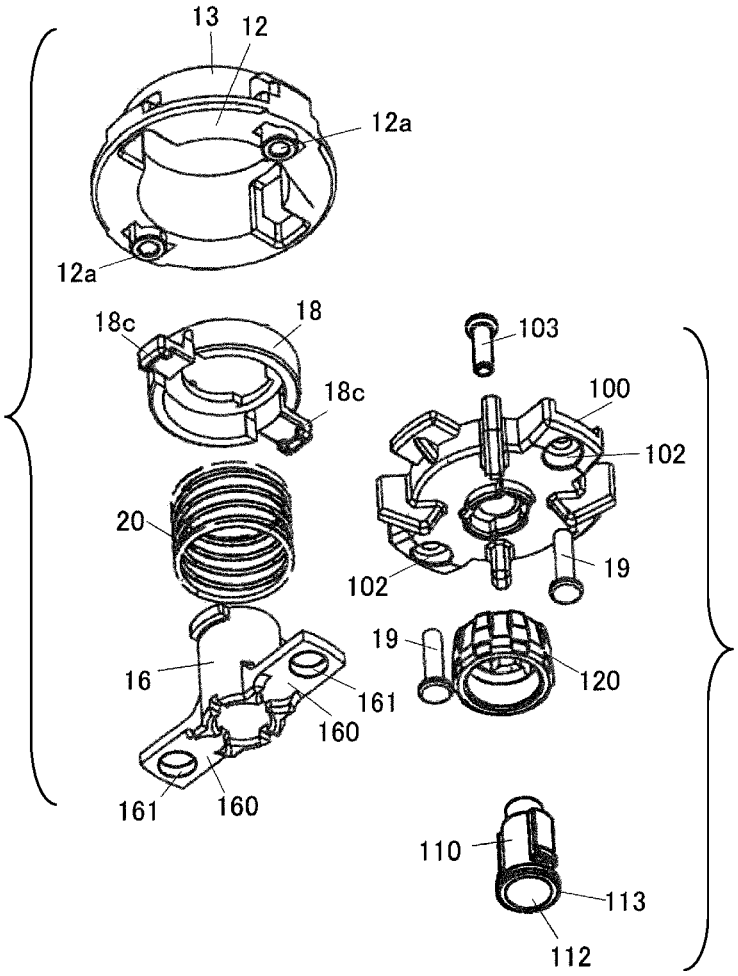
FIG. 5 is an exploded perspective view showing the shaft part when viewed from the lower side.

FIG. 4 is an exploded perspective view showing the shaft part 10 when viewed from the upper side. FIG. 5 is an exploded perspective view showing the shaft part 10 when viewed from the lower side. As shown in these drawings, the shaft part lower part is provided with a plate-shaped mounting member 100, the first ground contact member 110 and the second ground contact member 120.

At the upper surface center of the mounting member 100, a spot facing hole 101 is formed. Further, in each of the right and left of the mounting member 100, a screw inserting hole 102 is formed.

At the lower side of the mounting member 100, a rod-shaped first ground contact member 110 and an annular-shaped second ground contact member (wheel-shaped body) 120 are provided. That is, the shaft 111 of the first ground contact member 110 passes through a central hole 121 of the second ground contact member 120 from the lower side, and in the shaft 111, a male screw 103, which is inserted through the spot facing hole 101 of the mounting member 100 from the upper side, is screwed.

Here, the first ground contact member 110 and the second ground contact member 120 will be described.

Figure 6:
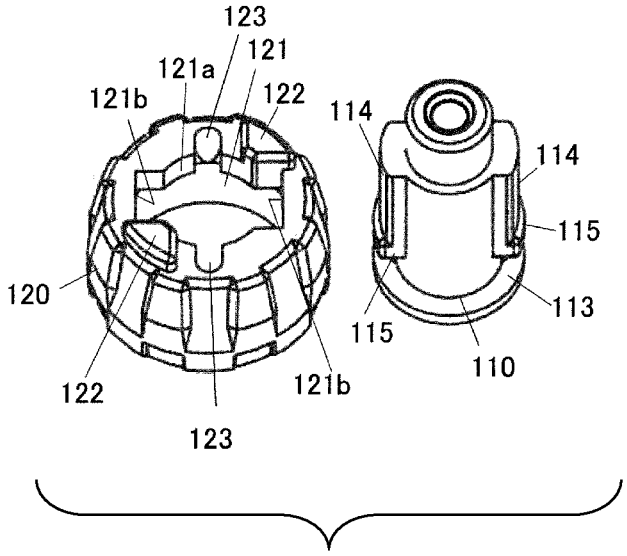
FIG. 6 is a perspective view showing a ground contact member.

The first ground contact member 110 is provided with a shaft 111 arranged around the shaft center of the spinning top toy 1, and a hemispherical-shaped ground contact part 112 (see FIG. 5) mounted to the lower end of the shaft 111. A flange 113 is provided at the boarder between the ground contact part 112 and the shaft 111 (see FIG. 6). Further, at each of the right and left of the outer circumferential surface of the shaft 111, as shown in FIG. 6, an overhanging part 114 is provided to overhang in the outward radial direction and extend in the vertical direction. In the lower end of each overhanging part 114, a projection 115, which projects in the outward radial direction, is provided. Further, not shown in the drawings, in the shaft 111, a protrusion, which extends in the vertical direction between the projection 115 and the flange 113, is provided.

On the other hand, at the ceiling part of the second ground contact member 120, the aforementioned hole 121 is formed. The hole 121 is formed to be capable of inserting the shaft 111 of the first ground contact member 110 from the lower side. That is, the hole 121 has a shape connecting the circular shape hole part 121*a* capable of inserting the shaft 111 of the first ground contact member 110 and two notch parts 121*b* capable of inserting the overhanging parts 114 and the projections 115 of the first ground contact member 110. The lower edge of the hole 121 becomes hollow. Further, at the edge configuring the circular shape hole part 121*a*, grooves 123 for positioning are formed. In addition, at the ceiling part of the second ground contact member 120, triangular shape projections 122 are formed at the edge of the notch parts 121*b*.

(2) Shaft Part Upper Part

In the flange 12 and the cylindrical part 13, a hole 14 is formed at each of the sections faced in the front and back direction across the shaft center. In the cylindrical part 13, a projection part 15 is formed at each of the sections faced in the right and left direction across the shaft center. The outer surface of the projection parts 15 is flush with the outer circumferential surface of the flange 12.

Further, as shown in FIGS. 2, 4, and 5, at the inside of the cylindrical part 13, a cylindrical body 16 (an example of a shaft part body) is provided. The cylindrical body 16 has hollow inside and opens downwardly. Further, at the outer circumferential lower end of the cylindrical body 16, a projection piece 160 overhanging in each of the right and left is provided. In each projecting piece 160, a screw inserting hole 161 is formed.

Further, the shaft part 10 is provided with an annular-shaped pressing member 18. The pressing member 18 is provided in a manner of surrounding the outer circumference of the cylindrical body 16 inside the cylindrical part 13. At the outer circumference lower end of the pressing member 18, leg parts 18*c* are provided. The leg part 18*c* is formed at each of the sections faced in the front and back direction across the shaft center. In the pressing member 18, the upward movement of the leg parts 18*c* is restricted by the upper edge of the holes 14, and normally, the upper end of the pressing member 18 is positioned at the same height as the upper end of the cylindrical part 13. Further, at the upper surface of the ceiling part of the pressing member 18, a protruding strip (projection) 21 extending in the radial direction is formed at each of the sections faced in the right and left direction across the shaft center.

(3) Assembly of Shaft Part 10

The pressing member 18 is fitted to the cylindrical part 13 mounted with the flange 12 from the lower side, and the cylindrical body 16 in which the spring 20 is wound up is fitted to the pressing member 18 from the lower side. For the convenience of explanation, this assembly is called as an upper part assembly. On the other hand, the first ground contact member 110 and the second ground contact member 120 are assembled to the mounting member 100. For the convenience of explanation, this assembly is called as a lower part assembly.

Next, the upper part assembly and the lower part assembly are brought close to each other. The male screws 19 pass through the screw inserting holes 102 of the mounting member 100 and the screw inserting holes 161 of the projecting pieces 160 and are screwed to the female screws 12*a* of the flange 12.

With this, the shaft part 10 is assembled.

(4) Operation of Shaft Part 10

Figure 7:
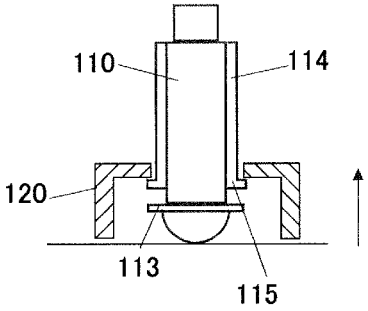
FIGS. 7(A) and 7(B) show a state of the ground contact member.
Figure 7:
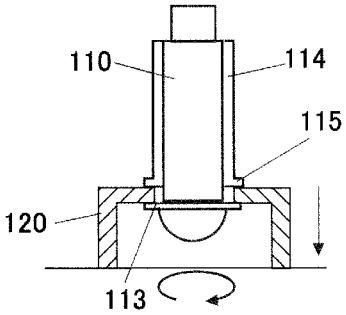

When it becomes the state in which the second ground contact member 120 is pushed into the body 40 side (see the first state shown FIG. 7(A)), the edge of the hole 121 of the second ground contact member 120 is slightly sat on the projections 115 of the first ground contact member 110, so as to maintain the pushed-in state. In the second state, the ground contact part 112 of the first ground contact member 110 is slightly projected from the lower end of the second ground contact member 120. From this state, the second ground contact member 120 is pulled out by a hand. Then, the edge of the hole 121 of the second ground contact member 120 gets over the projections 115 of the first ground contact member 110, and the edge of the hole 121 abuts to the flange 113. The second ground contact member 120 is rotated in the counterclockwise direction in the plane view. The projections 122 of the second ground contact member 120 abut to the side surface of the overhanging parts 114 of the first ground contact member 110. On the other hand, the first projections 122 are sandwiched between the flange 113 and the projections 115, so that the vertical movement of the second ground contact member 120 is blocked. Further, the grooves 123 of the second ground contact member 120 and the protrusions (not shown) of the first ground contact member 110 are fitted to each other, so that the rotation of the second ground contact member 120 is blocked. This state is the second state which is shown in FIG. 7(B). In order to perform the processes from the second state to the first state, the reversed procedure can be performed.

2. Regarding Flywheel 30

Figure 3:
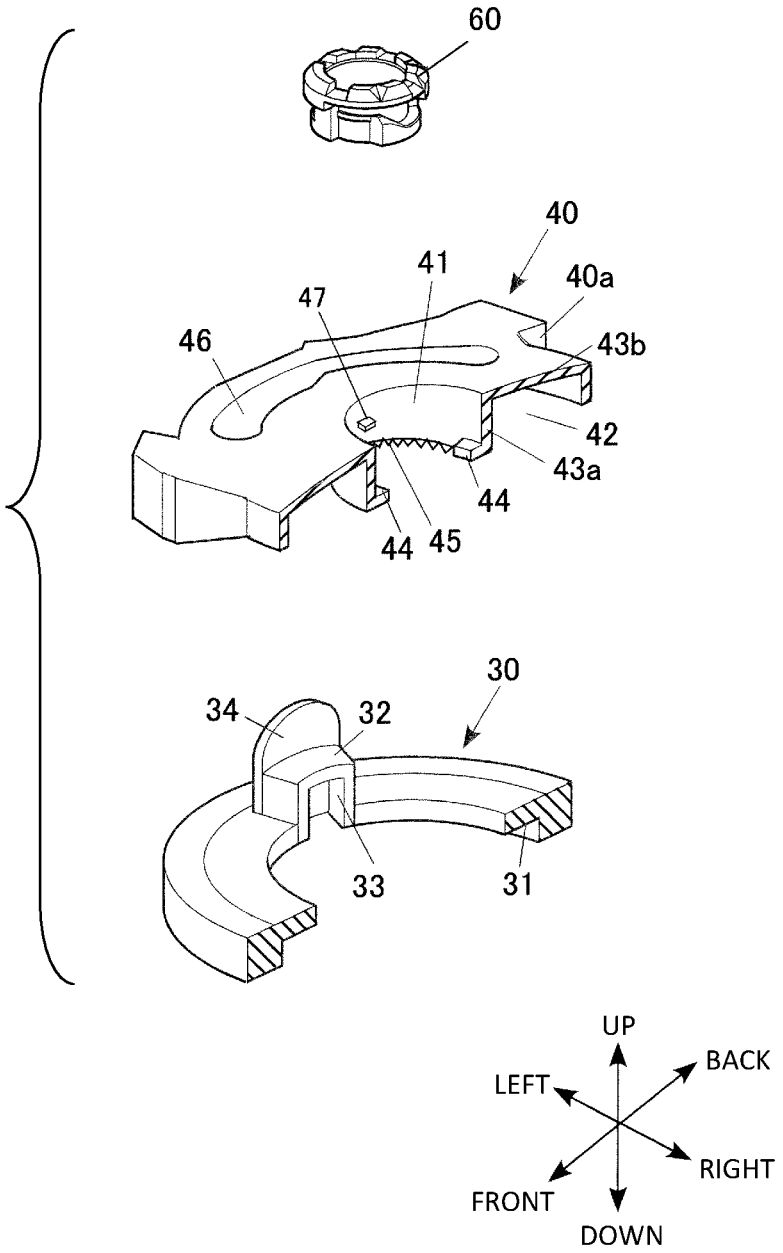
FIG. 3 is a perspective view showing a half of a body and a flywheel of the spinning top toy.

As shown in FIG. 2, the flywheel 30 has a plate like shape. As shown in FIG. 3, on the bottom surface of the flywheel 30, an annular step part 31 capable of storing the flange 12 of the shaft part 10 from the lower side is formed. Further, on the upper surface of the flywheel 30, a projection part 32 overhanging upwardly is formed at each of the sections faced in the right and left direction across the shaft center. In the lower side part of each projection part 32, a recessed part 33 capable of storing the projection part 15 of the shaft part 10 from the lower side is formed. Further, on the upper surface of the flywheel 30, a tongue-piece part 34 extending upwardly at directly outside of each projection part 32 is formed. The tongue-piece parts 34 are projected higher than the projection parts 32.

3. Regarding Body 40

As shown in FIG. 2, in the outer circumference of the body 40, protrusions and recesses 40*a* are formed. Further, at the center of the body 40, a circular hole 41 is formed. In addition, on the lower surface of the body 40, as shown in FIG. 3, an annular recessed part 42 capable of storing the projection parts 32 of the flywheel 30 from the lower side is formed. At the inner circumferential surface lower end of an inner circumferential wall 43*a* which partitions the annular recessed part 42, a hook (engagement part) 44 overhanging inside in the radial direction at each of the sections faced in the front and back direction across the shaft center is projected.

Further, at the middle part in the vertical direction on the inner circumferential surface of the inner circumferential wall 43*a*, a projection 47 overhanging inside in the radial direction at each of the sections in the right and left direction faced across the shaft center is projected.

Further, on the lower end surface of the inner circumferential wall 43*a*, a raised part 45 forming continuous protrusions and recesses and meshing with the aforementioned protruding strips 21 at each of the sections faced in the right and left direction across the shaft center is formed. Further, at the ceiling wall 43*b* which partitions and forms the annular recessed part 42 of the body 40, arcuate slits 46 capable of inserting tongue-piece parts 34 of the flywheel 30 from the lower side are formed. The length of the arcuate slits 46 has sufficient length to move the tongue-piece parts 34. Further, one end part of the arcuate slits 46 has a narrow width, so that the hooks 54*b* of the launcher 50 which will be described later are engaged to the lower edges.

4. Regarding Identification Part 60

As shown in FIG. 2, an identification part 60 is mounted to the circular hole 41. The identification part 60 is used for identifying the spinning top toy 1 or the identification of a player. For the identification, in the present embodiment, not shown in the drawings, a plurality of identification parts in which decorations and/or colors, etc. are different are offered, and one of the identification parts 60 which is selected by the player is mounted in the circular hole 41 by using the projections 47 in a screw manner.

Assembly Method

Next, an example of an assembly method of the spinning top toy 1 will be described. Here, it assumes that the assembly of the shaft part 10 has been already completed. Further, it assumes that the assembly of mounting the identification part 60 to the circular hole 41 has been already completed.

First, the projection parts 15 of the shaft part 10 are fitted to the recessed parts 33 of the flywheel 30 from the lower side, and the shaft part 10 and the flywheel 30 are assembled to become the fitting state.

Next, the assembled body brings to the position close to the body 40 from the lower side. In this case, the tongue-piece parts 34 of the flywheel 30 of the aforementioned assembled body are fitted to the predetermined ends of the arcuate slits 46 of the body 40 (see FIG. 8(A)). In this state, it is the state in which the hooks 17 of the shaft part 10 and the hooks 44 of the body 40 are not overlapped in the vertical direction. This state is the disassembled state.

After that, the shaft part 10 of the aforementioned assembled body pushes to the body 40 side. Then, first, the flywheel 30 is pushed to the lower surface of the body 40. Further, the spring 20 contracts and the hooks 17 of the shaft part 10 are relatively pushed up to the position higher than the hooks 44 of the body 40.

Figure 8:
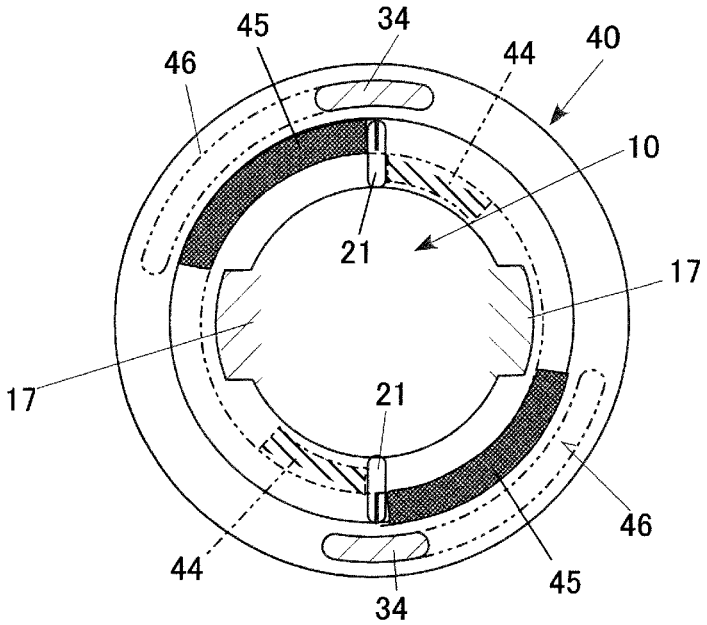
FIGS. 8(A) and 8(B) show an assembled state of the body and the shaft part.
Figure 8:
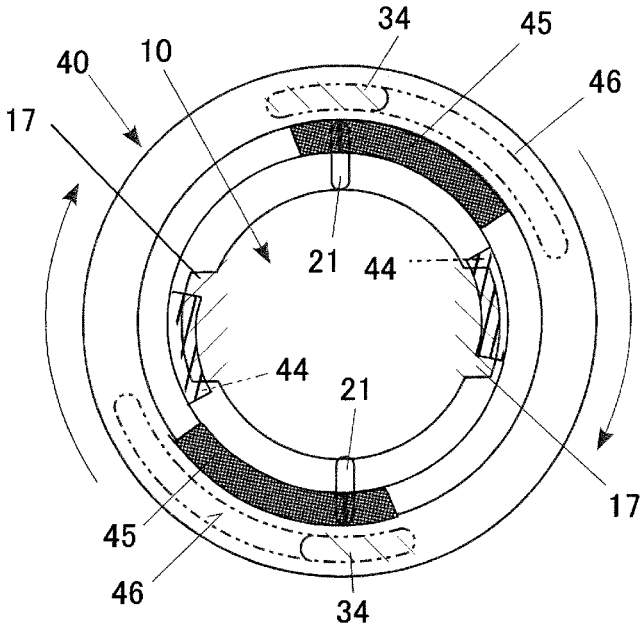

The shaft part 10 is rotated with respect to the body 40 integrated with the flywheel 30 until the tongue-piece parts 34 move to the ends opposite side of the aforementioned predetermined ends (see FIG. 8(B)). In this case of the rotation, the body 40 and the flywheel 30 and the shaft part 10 are relatively rotated, and in FIG. 8(B), it shows the state in which the body 40 is rotated with respect to the flywheel 30. Then, it becomes the state in which the hooks 17 of the shaft part 10 and the hooks 44 of the body 40 are overlapped in the vertical direction. When releasing the shaft part 10 from hand, the lower surface of the hooks 17 of the shaft part 10 and the upper surface of the hooks 44 of the body 40 abut each other by the energizing force of the spring 20. The state in which the lower surface of the hooks 17 of the shaft part 10 and the upper surface of the hooks 44 of the body 40 abut each other is the assembled state. With this, the shaft part 10, the flywheel 30 and the body 40 are engaged, and the spinning top toy 1 is assembled.

How to Play

Next, an example of how to play with the spinning top toy 1 will be described. In this example of how to play, by rotating the spinning top toy 1, it performs a battle with the opponent's spinning top toy 1.

Figure 9:
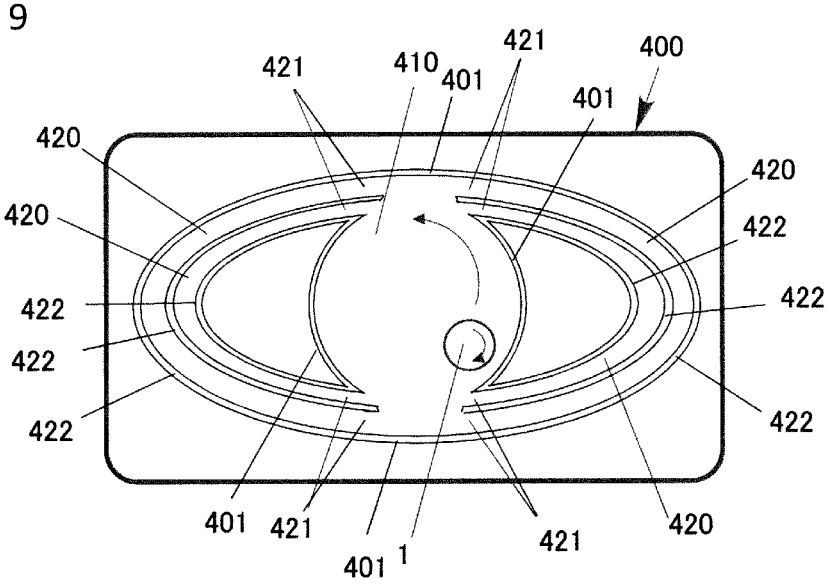
FIG. 9 is a plane view showing a game board.

As shown in FIG. 9, a game board 400 used in this case is shown. In this game board 400, a cone-shaped battle field 410 and a traveling path 420 connected to the battle field 410 are provided. The battle field 410 is formed in a circular shape in a plane view, and a wall 410 surrounding the field is formed. The traveling path 420 is connected to the battle field 410 through the defective part of the wall 401. In each of both sides of the traveling path 420, a wall 420 is formed. An entrance/exit passage 421 of the spinning top toy 1 is formed at the connecting part between the battle field 410 and the traveling path 420. According to the traveling path 420, the spinning top toy 1 entered from one entrance/exit passage 421 to the traveling path 420 is returned from the other entrance/exit passage 421 to the battle field 410.

Figure 10:
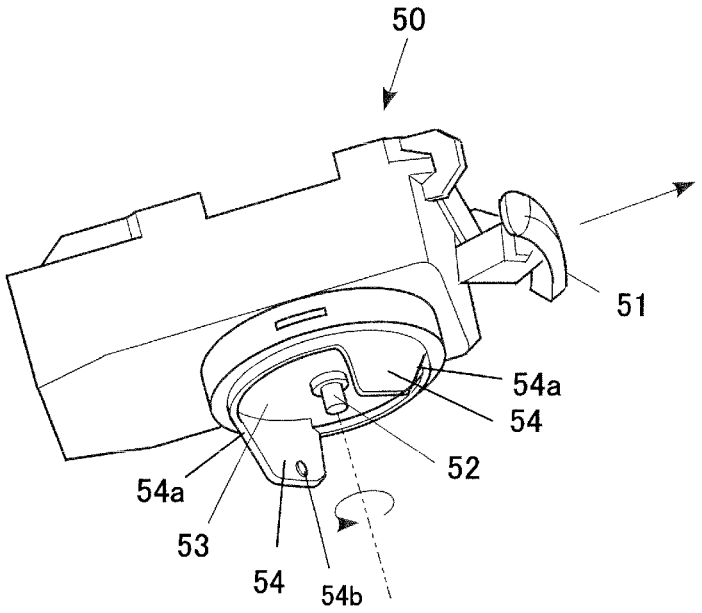
FIG. 10 is a perspective view showing a launcher.

In FIG. 10, a charge of the rotation force of the spinning top toy 1 is performed by a launcher 50.

In the inside part, the launcher 50 is provided with a disk which is not shown, and the disk is energized in one rotational direction by the power spring which is not shown. When the string, which is not shown, wound around the disk is pulled by a handle 51, the disk is rotated, and therefore, the spinning top holder 53 is rotated. The rotation of the spinning top holder 53 is transmitted to the spinning top toy 1 by the forks 54 projected downwardly, so that the spinning top toy 1 is rotated.

In this case, the forks 54 are inserted to the arcuate slits 46 of the body 40, and the hooks 54*b* are engaged with the lower edge of the arcuate slits 46. When the handle 51 of the launcher 50 is pulled to the end, the rotation of the disk and further, the spinning top holder 53 is stopped, and on the other hand, the spinning top toy 1 is rotated further by the inertia force, so that the spinning top toy 1 is released from the spinning top holder 53 in accordance with the inclined surface 54*a* of the forks 54. In FIG. 5, a reference numeral 52 denotes a rod capable of being projected from and retracted into the spinning top holder 53. The rod 52 is pressed by the upper surface of the spinning top toy 1 and is retracted into the spinning top holder 53 when the spinning top toy 1 is mounted to the spinning top holder 53. For example, the rod 52 is used to detect whether the spinning top toy 1 is attached or detached.

The second ground contact member 120 of the shaft part 10 is set in the first state or the second state in advance before applying the rotational energizing force to the spinning top toy 1 by the launcher 50. The rotational energizing force is applied to the spinning top toy 1 by the launcher 50, and the spinning top toy 1 is launched to the battle field 410. Then, the launched spinning top toy 1 is rotated in the battle field 410.

When the second ground contact member 120 is set in the first state, without the case right after the launching or the case colliding with the opponent's spinning top toy, it generally stays and is rotated at one location at the center of the battle field 410, and it is collided with the opponent's spinning top toy. Of course, when colliding, the spinning top toy 1 is flicked out and slightly moved around due to the collision.

On the other hand, when the second ground contact member 120 of the shaft part 10 is set in the second state, the lower surface of the second ground contact member 120 is grounded and strongly kicks the board surface, so that the spinning top toy 1 largely moves around. Sometimes, while rolling the wall 401 by the outer circumference of the second ground contact member 120, or directly, it is entered from the entrance/exit passage 421 to the traveling path 420. The spinning top toy 1 entered to the traveling path 420 rolls the floor or the wall 421 by the corner part or the outer circumference of the second ground contact member 120, and it runs along the traveling path 420 and is returned from the other entrance/exit passage 421 to the battle field 410. Then, it is collided with the opponent's spinning top toy.

As described above, when the spinning top toy 1 collides with the opponent's spinning top toy 1, by the impact force or friction, etc. due to the collision, in the body 40, the force is applied in the direction opposite to the rotation direction of the shaft part 10 and the flywheel 30, and with this, the body 40 is relatively rotated in the direction opposite to the rotation direction of the shaft part 10 and the flywheel 30. The protruding strips 21 are meshed with the raised part 45 of the body 40, and the energizing force of the spring 20 is applied to the protruding strips 21, so that every time the impact force is applied by the collision, the shaft part 10 is relatively rotated with respect to the body 40 and the meshing position is changed. When reaching the engagement releasing position, the engagement of the hooks 44 of the body 40 and the hooks 17 of the shaft part 10 is released, and by the energizing force of the spring 20, the body 40 is separated from the shaft part 10. As shown in the right side of FIG. 1, the spinning top toy 1 is disassembled.

Second Embodiment

Figure 11:
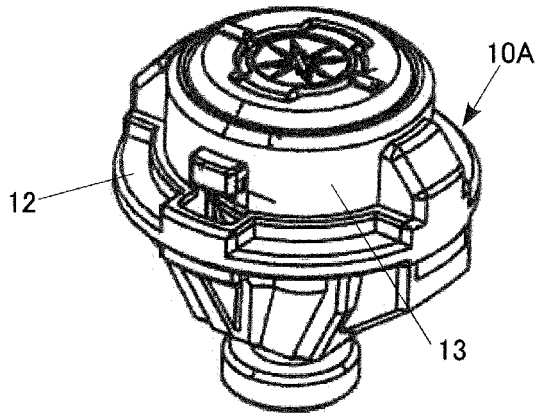
FIG. 11 is a perspective view showing a shaft part of a spinning top toy according to the second embodiment.

FIG. 11 shows a shaft part 10A of the spinning top toy of the second embodiment.

In the spinning top toy 1 of the second embodiment, the shaft part 10A is only different from the shaft part 10 of the spinning top toy 1 of the first embodiment. Accordingly, only shaft part 10A will be described. In the shaft part 10A, the components corresponding to the components of the shaft part 10 will be denoted as the same reference numerals, and the detailed explanation will be omitted.

(1) Shaft Part Lower Part

Figure 12:
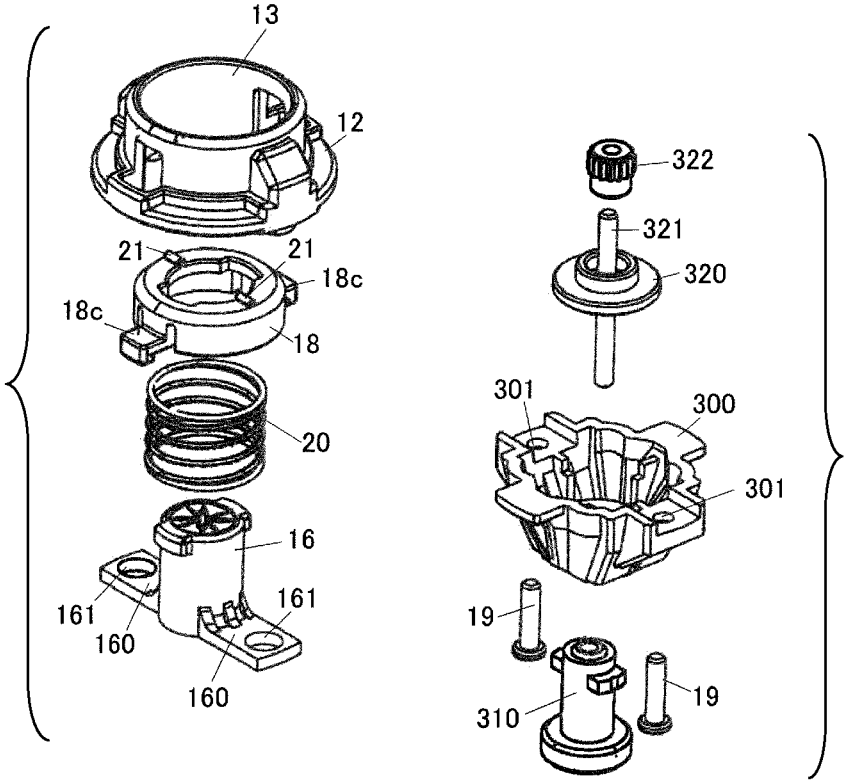
FIG. 12 is an exploded perspective view showing the shaft part when viewed from the upper side.
Figure 12:
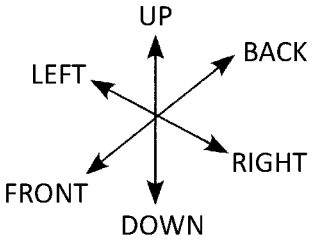
Figure 13:
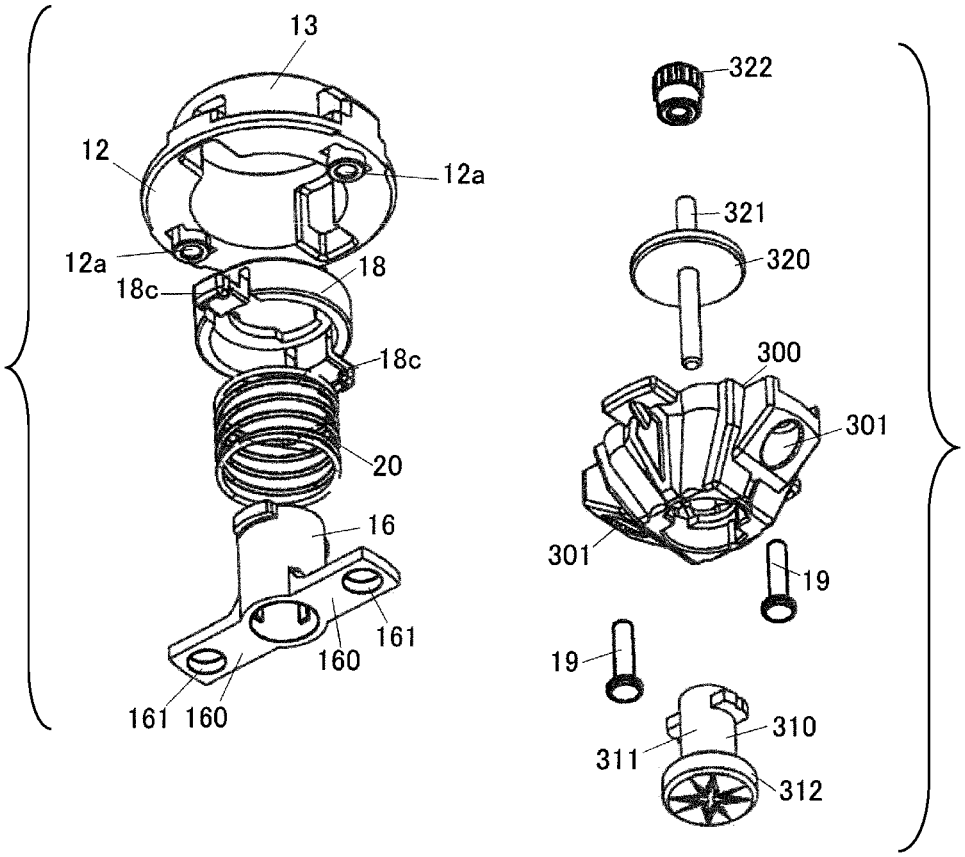
FIG. 13 is an exploded perspective view showing the shaft part when viewed from the lower side.

FIG. 12 is an exploded perspective view showing the shaft part 101A when viewed from the upper side. FIG. 13 is an exploded perspective view showing the shaft part 101A when viewed from the lower side. As shown in these drawings, the shaft part lower part is provided with a bowl-shaped mounting member 300 and a ground contact member (wheel-shaped body) 310 assembled to the mounting member 300.

Figure 14:
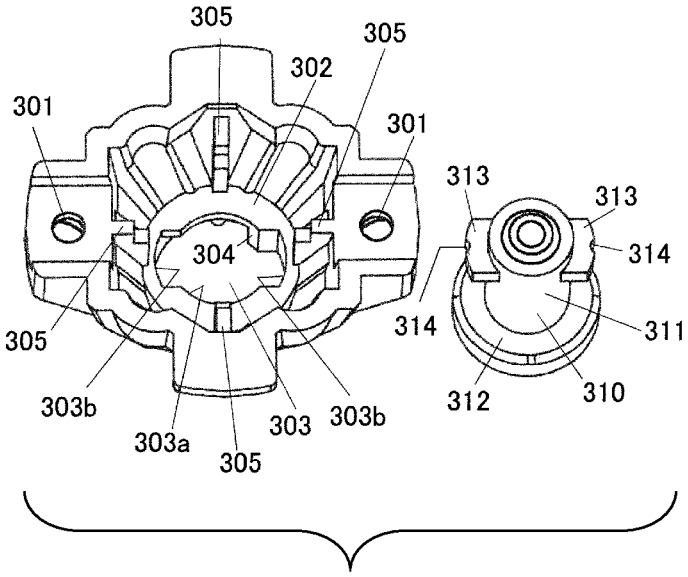
FIG. 14 is a perspective view showing a mounting member and a ground contact member.

A screw inserting hole 301 is formed in each of the right and left of the mounting member 300. The inner circumference of the mounting member 300 becomes narrower toward the lower side, and as shown in FIG. 14, an overhanging part 302 overhanging inwardly at the half way in the vertical direction is provided. A central hole 303 is partitioned by the overhanging part 302. The hole 303 has a shape which connects a circular-shaped hole part 303*a* and two arcuate notch parts 303*b*.

The lower side of the overhanging part 302 is generally hollow, but the edge at one end side in the circumferential direction of the notch parts 303*b* extends to the lower end of the mounting member 300. A regulating part 304 is functioned as a guide when performing the vertical movement of the ground contact member 310, and it is functioned as a stopper when fixing the ground contact member 310.

Further, not shown in the drawings, at the inner circumference of the mounting member 300, projections extending in the vertical direction are provided under the circular-shaped hole part 303*a*.

Here, the ground contact member 310 will be described.

The ground contact member 310 is arranged in the shaft center of the spinning top toy 1, and it is provided with a shaft 311, and a disk-shaped ground contact part (wheel-shaped body) 312 assembled to the lower end of the shaft 311. Further, at each of the right and left of the outer circumference of the shaft 311, a projecting piece 313 overhanging outward in the radial direction is provided. The top end of the projecting piece 313 is curved in an arcuate shape. At the top end, a groove 314 is formed.

On the other hand, on the upper side of the mounting member 300, a disk 320 is provided. This disk 320 is placed at a step part of stepped-shape support parts 305 formed on the inner surface of the mounting member 300. At the center of the disk 320, the shaft 321 is provided to penetrate loosely, and at the upper end part of the shaft 321, a fall-off prevention part 322 is mounted. Further, the shaft 321 is fitted to the shaft 311 of the ground contact member 310.

(3) Assembly of the Shaft Part 10A

The pressing member 18 is fitted to the cylindrical part 13 assembled with the flange 12 from the lower side, and the cylindrical body 16 in which the spring 20 is wounded up is fitted to the pressing member 18 from the lower side. For the convenience of explanation, this assembly is called as an upper part assembly. On the other hand, the ground contact member 310 is inserted from the lower side of the mounting member 300, and the shaft 321 mounted to the head part of the fall-off prevention part 322 is inserted from the central hole of the disk 320 and the shaft 321 is fitted to the shaft 311. For the convenience of explanation, this assembly is called as a lower part assembly.

Next, the upper part assembly and the lower part assembly are brought close to each other. The mal screws 19 are inserted to the screw inserting holes 301 of the mounting member 300 and the screw inserting holes 161 of the projecting piece 160 from the lower side, and are screwed to the female screws 12*a* of the flange 12.

With this, the shaft part 10A is assembled.

(4) Operation of the Shaft Part 10A

Figure 15:
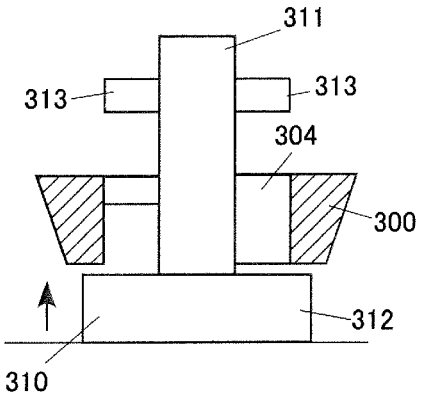
FIGS. 15(A) and 15(B) show a state of the ground contact member.
Figure 15:
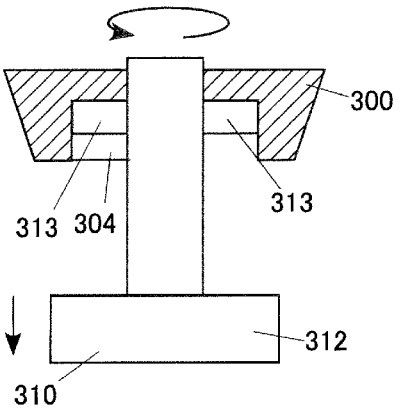

When it becomes the state in which the ground contact member 310 is pushed into the body 40 side (the first state shown in FIG. 15(A)), the ground contact member 310 is held in the rotatable state with respect to the mounting member 300. In the first state, the ground contact member 310 is held in the rotatable state with respect to the mounting member 300, so that the spinning top toy 1 does not largely move around. In order to change from the first state to the second state shown in FIG. 15(B), the ground contact member 310 is rotated to search a position for pulling the ground contact member 310, that is, a position for matching the arcuate notch parts 303*b* of the mounting member 300 and the projecting pieces 313 of the ground contact member 310. The ground contact member 310 is pulled by hand. The ground contact member 310 is rotated until abutting to the regulating part 304. Then, the grooves 314 of the ground contact member 310 and the projections (not shown) of the mounting member 300 are fitted to each other, and by abutting the fall-off prevention part 322 to the disk 320, the rotation or the vertical movement of the ground contact member 310 is blocked. This state is the second state. In the second state, the spinning top toy 1 largely moves around, and the ground contact member 310 rolls the wall.

In order to perform the processes from the second state to the first state, the reversed procedure can be performed.

Modification Example of the Present Invention

The embodiments of the present invention were described above, but the present invention is not limited to the aforementioned embodiments, and needless to say, various modifications may be made within the scope that does not depart from the essential point of the present invention.

Effect of the Invention

According to first to third aspects, the annular-shaped ground contact part is fixed by the manual operation when separating from the body, and the lower surface or the outer circumference of the annular-shaped ground contact part becomes capable of being contacted to a contact surface, so as to realize the spinning top toy suitable for traveling.

According to a fourth aspect, in the second state, when the annular-shaped ground contact part goes into the traveling path, it travels, so as to realize an innovative spinning top toy set.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

What is claimed is:

1. A spinning top toy for spinning on a surface, comprising:

a shaft part including a shaft part body and a ground contact part being integrally formed with the shaft part body, the shaft part extending in an axial direction; and a body being detachable configured on the shaft part, the body being rotatable against the shaft part when an impact is applied to the body, the ground contact part including a first ground contact member at a tip thereof and a second ground contact member having a wheel shape, the second ground contact member being slidably configured on the shaft part body, the second ground contact member being configured for a user to move between a first position a second position, the second position being closer to the surface than the first position in the axial direction, the second ground contact member being configured to be in contact with the surface when at the second position, when the second ground contact member is at the first position, the second ground contact member being not in contact with the surface, when the second ground contact member is at the second position, the first ground contact member being not in contact with the surface, the wheel shape being in a disk shape, the ground contact part being configured to rotate around the axial direction with respect to the shaft part body.

2. A spinning top toy for spinning on a surface, comprising:

a shaft part including a shaft part body and a ground contact part being integrally formed with the shaft part body, the shaft part extending in an axial direction; and a body being configured on the shaft part, the ground contact part including a first ground contact member at a tip thereof and a second ground contact member having a wheel shape, the second ground contact member being slidably configured on the shaft part body, the second ground contact member being configured for a user to move between a first position and a second position, the second position being closer to the surface than the first position in the axial direction, the second ground contact member being configured to be in contact with the surface when at the second position, the shaft part including a projection being formed in circular and a flange being formed in circular, the flange being configured closer to the surface than the projection to the surface, a part of the second ground contact member being inserted at a gap formed between the projection and the flange when the second ground contact member is at the second position.

3. The spinning top toy according to claim 2, wherein when the second ground contact member is at the first position, the second ground contact member is not in contact with the surface, and when the second ground contact member is at the second position, the first ground contact member is not in contact with the surface.

4. The spinning top toy according to claim 2, wherein the wheel shape is in a disk shape, and the ground contact part is configured to rotate around the axial direction with respect to the shaft part body.

5. A spinning top toy set comprising:

a spinning top toy according to claim 2; and a game board forming a circular battle field in a plane view and a traveling path connecting to the battle field.

* * * * *